US010700465B2

(12) United States Patent
Deskin

(10) Patent No.: US 10,700,465 B2
(45) Date of Patent: Jun. 30, 2020

(54) ELECTRICAL PLUG SHOCK PROTECTION DEVICE

(71) Applicant: Samuel Deskin, Los Angeles, CA (US)

(72) Inventor: Samuel Deskin, Los Angeles, CA (US)

( * ) Notice: Subject to any disclaimer, the term of this patent is extended or adjusted under 35 U.S.C. 154(b) by 0 days.

(21) Appl. No.: 16/132,392

(22) Filed: Sep. 15, 2018

(65) Prior Publication Data

US 2020/0091646 A1 Mar. 19, 2020

(51) Int. Cl.
*H01R 13/447* (2006.01)

(52) U.S. Cl.
CPC ..... *H01R 13/447* (2013.01)

(58) Field of Classification Search
CPC ..... H01R 13/44; H01R 13/447
USPC ..... 439/141
See application file for complete search history.

(56) References Cited

U.S. PATENT DOCUMENTS

| | | | | |
|---|---|---|---|---|
| 2,458,153 | A | 1/1949 | Festge | |
| 3,147,055 | A | 9/1964 | Rubens | |
| 3,201,740 | A | 8/1965 | Rubens | |
| 3,210,717 | A | 10/1965 | Brown | |
| 3,513,435 | A | 5/1970 | Degaetano | |
| 3,575,684 | A | 4/1971 | McIntyre | |
| 3,631,320 | A | 12/1971 | Eckert | |
| 3,737,835 | A | 6/1973 | Clement et al. | |
| 3,740,694 | A | 6/1973 | Fisher | |
| 3,754,205 | A | 8/1973 | Lenkey | |
| 3,763,457 | A | 10/1973 | Whippo | |
| 4,340,267 | A | 7/1982 | Nukaga | |
| 4,391,481 | A | 7/1983 | Golden | |
| 4,445,739 | A | 5/1984 | Wooten | |
| 4,810,199 | A | 3/1989 | Kar | |
| 5,030,119 | A | 7/1991 | Lowe | |
| 5,252,082 | A | 10/1993 | Hsieh et al. | |
| D354,270 | S | 1/1995 | Cichoracki | |
| 5,518,411 | A | 5/1996 | Belleci | |
| 5,599,196 | A | 2/1997 | Powell et al. | |
| 6,062,881 | A | 5/2000 | Ellison | |
| 6,577,081 | B2 * | 6/2003 | Dickie | H05B 33/08 315/363 |
| 6,604,954 | B2 | 8/2003 | Chu et al. | |
| 7,094,080 | B2 * | 8/2006 | Dickie | H01R 13/44 439/141 |
| 8,277,237 | B1 | 10/2012 | Cherish | |
| 8,770,994 | B1 * | 7/2014 | Fagan | H01R 13/44 439/141 |
| 8,956,168 | B2 * | 2/2015 | Al-Anzi | H01R 13/6683 439/159 |
| 8,961,202 | B2 | 2/2015 | Busson, Jr. | |

(Continued)

*Primary Examiner* — Abdullah A Riyami
*Assistant Examiner* — Nader J Alhawamdeh
(74) *Attorney, Agent, or Firm* — Canady & Lortz LLP; Bradley K. Lortz

(57) ABSTRACT

An electrical plug safety device is disclosed having a first planar section having a first pair of holes therethrough, a second planar section having a second pair of holes therethrough, and a pair of collapsible passages each having a first opening joined to one of the first pair of holes of the first planar section and each having a second opening joined to one of the second pair of holes of the second planar section. Each of the pair of collapsible passages comprises a single constriction between the first opening and the second opening. Prongs of an electrical plug inserted through the collapsible passages are shielded from contact as the plug is connected or disconnected from an outlet.

19 Claims, 8 Drawing Sheets

(56) References Cited

U.S. PATENT DOCUMENTS

| | | | | |
|---|---|---|---|---|
| 9,722,344 | B1 | 8/2017 | Hamilton | |
| 2005/0106909 | A1* | 5/2005 | Dickie | H01R 13/44<br>439/134 |
| 2011/0003494 | A1 | 1/2011 | Tang | |

* cited by examiner

ELECTRICAL PLUG SHOCK PROTECTION DEVICE

BACKGROUND OF THE INVENTION

1. Field of the Invention

The present invention relates to the field enhancing safety of electrical plugs to prevent access to live electrical prongs when connecting and disconnecting a plug to an electrical outlet or female plug.

2. Description of the Related Art

Since the rise of Nickolai Tesla's alternating current (AC) electrical power distribution there has been a concern for the hazard of electrical shocks. Notably, this hazard was the subject of a deliberate negative publicity campaign by Thomas Edison to garner favor for his competing direct current (DC) electrical power distribution system. However, AC electrical power distribution is fundamentally more efficient than DC power distribution, allowing it to fully displace DC despite Edison's efforts and the risk of electrical shock. Electrical plugs and sockets are the essential connections for electrical power distribution manipulated by the end user. Thus, these connections are where the electric shock is most likely to occur. The design of the electrical plugs and sockets and supporting devices is a critical factor in minimizing this risk.

The US Department of Commerce International Trade Administration (ITA) identifies fifteen types of electrical plugs in use today. Some of the plugs employ designs which allow them to be connected and disconnected with significantly reduced risk of electrical shock. In general, the safer designs employ a plug and socket that shields a user from any contact with the prongs until they are fully disconnected from the AC power. However, a few of the electrical plugs have designs that are not so shielded where a user could inadvertently make contact with the live electrical prongs (albeit only briefly) while the plug is being connected or disconnected. The US utilizes the Type A (the NEMA 1-15 which uses two prongs) and Type B (the NEMA 5-15 which uses two prongs and an additional ground) plugs. Both the Type A and Type B plugs employ designs which exhibit this risk; while they are being connected or disconnected from an outlet, there is a range of engagement where metal prongs are electrically connected and exposed to potential contact.

The less safe electrical plug and socket designs (such as the Type A and Type B plugs) present a relatively low but omnipresent risk to the public. Children and the disabled are particularly susceptible to risk of electrical shock using the less safe designs as they may not have the ability or understanding to maintain the care needed to safely connect and disconnect an electrical plug to avoid a shock. Accordingly, many devices have been developed over the years with the object of improving the safety of electrical plugs and outlets by preventing electric shock that can occur during the process of plugging and unplugging an electrical plug from an outlet.

In general, there are two types of prong shield devices in the prior art: one type uses a spring-loaded rigid retractable prong cover that slides into or along the plug body when in contact with the outlet and a second type of prong shield device uses a flexible, resilient sleeve that flattens between or spreads around the plug and/or receptacle.

A non-exhaustive list of the first type of prior art devices includes, the Brown Patent (U.S. Pat. No. 3,210,717), the Degaetano Patent (U.S. Pat. No. 3,513,435), the Lenkey Patent (U.S. Pat. No. 3,754,205), the Nukaga Patent (U.S. Pat. No. 4,340,267), the Wooten Patent (U.S. Pat. No. 4,445,739), the Belleci Patent (U.S. Pat. No. 5,518,411), the Ellison Patent (U.S. Pat. No. 6,062,881), the Chu Patent (U.S. Pat. No. 6,604,954) and the Busson Patent (U.S. Pat. No. 8,961,202). Generally, the safety feature of these devices is integrated into the design of the male pronged plug. Accordingly, these devices are not generally an after-market accessory that can be retrofitted to existing male plugs.

The second type of prior art devices employ sleeves or sheaths which temporarily cover the electrical prongs. Among devices employing sleeves or sheaths, some employ a flexible, resilient sleeve that spreads around the plug and receptacle while others flatten between the plug and receptacle. The devices employing sleeves or sheaths that spread around the plug and electrical socket are conspicuous in use.

There are a variety of existing devices which use a flexible, resilient sleeve that spreads around the plug and receptacle. For example, the Rubens Patent (U.S. Pat. No. 3,147,055) which discloses a "highly resistant sleeve of insulating material" that "completely surround[s] the prongs" of a plug with a "barrel shaped" opening that requires a "space [around the invention] to accommodate the excess resilient material that becomes present when the sleeve is squeezed by the complete insertion of the plug into the receptacle." Another is the Fisher Patent (U.S. Pat. No. 3,740,694) that discloses a series of "flaps . . . [that] are forced outwardly away from the plug prongs" covering the area of the outlet surrounding the plug. Yet another is the Golden Patent (U.S. Pat. No. 4,391,481) that discloses a "tubular shaped sheath [that] is fitted over a conventional electrical outlet plug and extends the length of the plug prongs" and effectively surrounds the wire, covering the entire plug assembly and a portion of the outlet. Still another is the Dickie Patent (U.S. Pat. No. 7,094,080) that discloses a device that gets "snap-fit to the front end of the plug" and surrounds the plug's entire face and lip. Lastly, the Fagan Patent (U.S. Pat. No. 8,770,994) discloses a child resistant safety plug accessory that is "equal to or longer than a prong length," and uses a "zip-tie to secure the strap to an electrical cord."

However, there are some existing devices employing sleeves or sheaths that are less conspicuous, using sleeves or sheaths that flatten between the plug and receptacle. For example, the Eckert Patent (U.S. Pat. No. 3,631,320) discloses a safety device wherein a "taper comprises a spiral of insulative material" that is intended to act as a "collapsing sleeve" around the prongs. Another is the Kar Patent (U.S. Pat. No. 4,810,199) that discloses an "elastically collapsible electrically insulating hood on the plug surrounding the prongs" made of a "foamed polymer material" "having at least two perforations therethrough." And again the Dickie Patent (U.S. Pat. No. 7,094,080) discloses a device "molded from plastic or manufactured from some other fairly rigid material." However, these devices also have weaknesses to be overcome. For example, the sleeves or sheaths of these devices are not structurally stable when uncompressing affecting reliable function which may cause the device to fail when they are needed to instantly pop-out to block access to the prongs and they can have a flattened height that is too thick which may cause the plug to not be completely engaged into the outlet when plugged in causing it to disengage inadvertently.

In view of the foregoing, there is a need in the art for devices and methods for reducing the risk of electrical shock when connecting and disconnecting power from an AC socket. There is a need for such devices to be inexpensive and inconspicuous in use. There is further a need for such devices and methods to be structurally stable and operate reliably and efficiently over many uses. There is also a need for such apparatuses and methods to readily retrofit almost any existing electrical plug. These and other needs are met by the present invention as detailed hereafter.

SUMMARY OF THE INVENTION

The electrical plug safety device can be removably affixed on the face of a male electric plug around the two flat parallel prongs. The device comprises a non-electric conducting elastomeric material that compresses when the prongs of the plug are inserted into an outlet and springs back as the plug is removed from the outlet. Its purpose is to block access by individuals, especially children and the disabled, to the prongs of the plug while the prongs are still conducting electricity as they are in the process of being disconnected from an outlet or a female plug. Many electrical plugs are not easy to pull out of outlets. Accordingly, individuals without experience using electrical plugs, lacking sufficient strength in their hands and/or an understanding of the danger of electric shock may pull the plug out as far as they can and then be tempted to reach between the prongs to gain a better grip in order to fully disconnect the plug only to get an electric shock.

This electrical plug safety device protects people from electric shock when a plug is partially removed from an electrical outlet or other female plug. As an electrical plug is being unplugged approximately the first ¼ inch of the electrical prongs still has current running through them when they are accessible to children's fingers and other conducting materials. Accordingly, at least 10% of the length of the prongs (but more typically 35%-40%) should be shielded by the device while the plug is being withdrawn from the outlet or female plug.

Typically, the safety device can comprise a non-conducting elastomeric material that compresses between the plug and the electrical outlet when the prongs of the plug are inserted into the electrical outlet and springs back out as the plug is removed from the electrical outlet, thereby blocking access to the prongs while they still have current flowing through them.

It is an object of this invention to provide an after-market accessory made of a non-conducting elastomeric material that discretely attaches to the face of a male-pronged electrical plug using adhesive.

A further object of this invention is for this accessory to be short enough to fully compress when the plug is fully installed into an electrical outlet or other female electrical plug. Embodiments of the invention can use a single constriction for each prong to be out of the way and virtually invisible during use.

Yet a further object of this invention is for the accessory to be long enough to spring back out as an electrical plug is disconnected to block access to the prongs while they have electricity flowing through them.

These and other objectives of the present invention will be understood by those of ordinary skill in the art after reading the following detailed description including the preferred embodiment, which is illustrated in the various figures and drawings.

A typical embodiment of the invention comprises an electrical plug safety device, including a first planar section having a first pair of holes therethrough, a second planar section having a second pair of holes therethrough, and a pair of collapsible passages each having a first opening joined to one of the first pair of holes of the first planar section and each having a second opening joined to one of the second pair of holes of the second planar section. Each of the pair of collapsible passages comprises a single constriction between the first opening and the second opening. The unitary structure can be injection molded from a resilient material. The device can comprise a unitary structure and the resilient material can comprise a non-conducting elastomeric material. The device can be compressed from an extended condition and held closed under retention force between a face of an electrical plug engaged in an outlet and returns to the extended condition upon removal of the electrical plug from the outlet.

In further embodiments, the single constriction of each of the pair of collapsible passages can comprise an elongated oval opening for a prong of an electrical plug. The single constriction of each of the pair of collapsible passages can be substantially midway between the first opening and the second opening. The pair of collapsible passages can be joined with the first planar section and the second planar section to form a pair of sealed conduits from a front side of the first planar section to a backside of the second planar section. Typically, an extended height of the collapsible sleeves and thicknesses of the first planar section and the second planar section can be to at least 10% of a length of a prong of an electrical plug. The first pair of holes in the first planar section and the second pair of holes in the second planar section can comprise space into which the pair of collapsible passages deform when the first planar section and the second planar section are compressed together.

In some embodiments, walls of each of the pair of collapsible passages can extend at approximately 45 degrees from the first planar section and at approximately 45 degrees from the second planar section towards the constriction. The walls of each of the pair of collapsible passages can form half conical sections at each end.

In some embodiments, a backside of the second planar section can include an adhesive area for affixing to a front surface (i.e. the face) of an electrical plug. This second planar section can be larger than the first planar section to afford greater surface area for the adhesive area. The adhesive area can comprise all of the flat surface of the backside of the second planar section or, alternately, the adhesive area can comprise a region between the first pair of holes on the backside of the second planar section. Any of the aspects related to various embodiments of the invention described herein can be used in any combination as will be understood by those skilled in the art.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

Figure 1A:
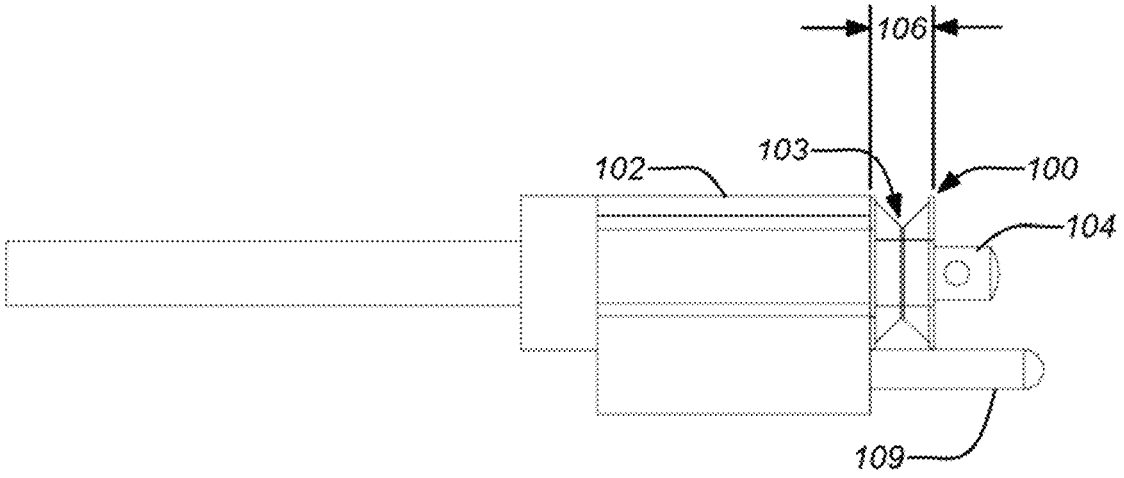
FIG. 1A illustrates a side view of the electrical plug safety device depicted fully extended and affixed with adhesive to the face of a three-pronged plug.

Embodiments of the present are distinguishable over the prior art and in some cases remedy the deficiencies of the prior art. The present invention is a compact and discrete after-market accessory that can be affixed to the face of an existing conventional electrical plug, flattening completely between the face of the electrical plug and an electrical outlet or female electrical plug when connected together. Embodiments of the present invention do not require an additional spring to make a prong cover retract or advance as with many prior art devices.

Regarding the prior art discussed in the background above, embodiments of the present invention improves on Ruben, Fisher, Golden, Dickie and Fagan's teachings by essentially becoming almost completely hidden from view between the face of the plug and the outlet and requires minimal space for the material to compress or hold onto the plug or wiring. This is an improvement because embodiments of the present invention are not an attractive nuisance as children will be less likely to interact with a device they do not notice when the plug is installed. Further, embodiments of the present invention are distinguished over Eckert, Kar and Dickie's teachings because they employ an elastomeric material.

Thus, the safety plug prong shield of the present invention is distinguishable from the known collapsible type of prong shield devices. It has a compact and inconspicuous design that allows the device to remain virtually unseen when the plug is in the outlet. Accordingly, the device does not draw the attention of the children it is intended to protect because the device is not strapped to the electric cord or cover the electric cord, plug assembly and/or a portion of the outlet as with some prior art devices. In addition, the device can be made from a non-conductive elastomeric material with a single constriction (also referred to as a flap, bellows, perforation or fold in prior art) around each prong with no tapering or spiraling.

As will be described hereafter, an after-market electrical plug safety device in accordance with embodiments of the invention can be comprised solely of a durable non-conductive elastomeric material that can be produced by injection molding. The device can include two openings, one for each of the two flat parallel prongs of a male electric plug. Each of the two openings can include one symmetrical corrugation (or constriction) having a length of approximately inch. The corrugation is long enough to protect a user from electric shock while disconnecting a plug and short enough to minimize the gap between the plug and the outlet when connected. The device will not cause the plug to inadvertently pop out when inserted into an outlet. The device can include elastomeric material surrounding the openings on one or both sides of the device to couple them together and to provide support for each other in order to ensure that they instantly spring out while the plug is being disconnected. The device can provide a surface to adhesively affix it to a male electric plug or outlet completely surrounding the prongs of the male electric plug to prevent accessibility to the prongs while the plug is in the process of being unplugged. The device includes a narrowest portion inside each corrugation (a constriction just narrow enough to accept the complete insertion of the prongs of the male electric plug). The device can be small enough to be virtually hidden from view between the face of the plug and the outlet. The device can use an adhesive material on the area surrounding openings on one side to affix the device to the face of the male electric plug when the prongs are inserted into the openings on that side. In addition, the device can also include a slight notch to clear the ground (earth) pin if the device is used with grounded plugs.

Significantly, embodiments of the present invention employ two stabilizing planar sections at each end of a pair of collapsible passages. Typically, prior art devices may employ only a single planar section at one end of a pair of sleeves. Accordingly, the sleeves of prior art devices are not stabilized and can become distorted, particularly if they become pressed between the plug and the outlet face in an uncontrolled manner. The sleeves are much more likely to become stuck in their compressed position or roll onto itself as the plug is disconnected. The second planar section coupled between the two passages stabilizes the passages as they are compressed and extended to allow reliable and repeated compression and extension function. In addition, the enhanced stabilization from a second planar section also enables the use of a very flexible material, such as highly flexible elastomeric materials. Some prior art devices require more rigid materials and/or thicker structural walls, which would yield a more conspicuous devices and/or a wider separation between the outlet and the plug in use.

Another important feature of the invention is that the device becomes very thin when compressed making the device inconspicuous as previously mentioned. In part, this thinness is enabled through the use of large holes in the two planar sections. The large holes form spaces large enough to be occupied by the material of the collapsible passages when the device is compressed. This allows the compressed thickness to be substantially as thick as only the two planar sections flat against one another.

It should be noted that although embodiments of the invention are described hereafter as a device that can be retrofitted to almost any plug, those skilled in the art will appreciate that an embodiment of the invention can alternately be integrated into a novel plug design.

2. Exemplary Electrical Plug Safety Device

FIGS. 1A-1B and 2A-2C are perspective views of the example electrical plug safety device 100 affixed with an adhesive 101 to the face of a three-prong power plug 102. Those skilled in the art will appreciate that the electrical plug safety device 100 is operable for use with a two- or three-pronged version of a male electrical plug 102, although only a three-pronged power plug 102 is illustrated here. This device 100 serves as an example and does not to limit the described embodiments of the invention and their uses. Further embodiments of the invention can be readily developed employing the principles described herein and applied to other electrical plug configurations as will be understood by those skilled in the art. For example, a device employing three passages between two planar sections, one for each prong of a three-prong power plug, is within the scope of the present invention. However, such an embodiment is less desirable because electrical shock is very unlikely by contact with the ground prong alone.

Figure 1B:
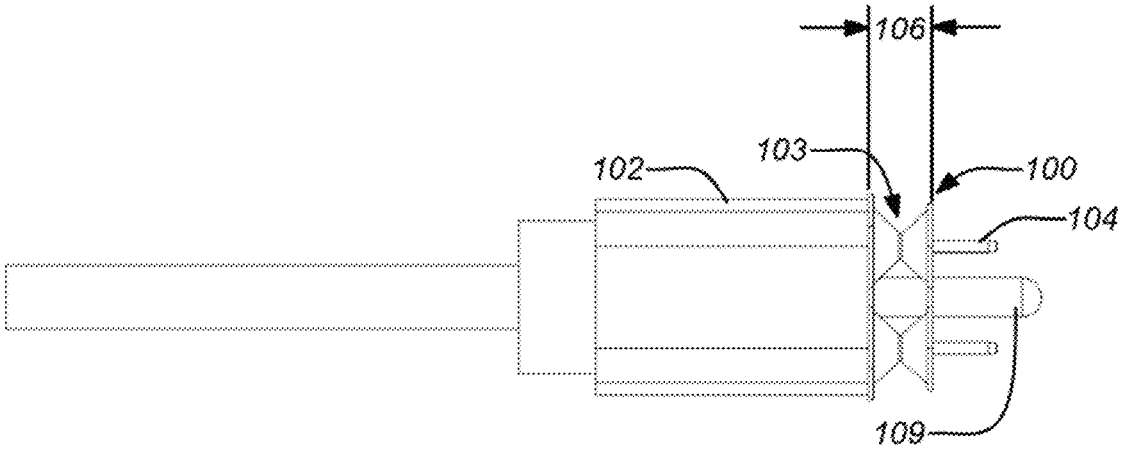
FIG. 1B illustrates a top view of the electrical plug safety device depicted fully extended and affixed with adhesive to the face of a three-pronged plug.

FIGS. 1A-1B illustrate a side and top view, respectively, of the electrical plug safety device 100 depicted fully extended and affixed with adhesive to the face of a three-pronged plug 102. Here, the device 100 is shown installed on a plug 102. An adhesive 101 (e.g. double-sided tape or any other suitable adhesive) is used between the rear planar section 111 surface and the front face of the plug 102 to affix the device to the plug 102 so that it will remain in place for many uses. (Location of the rear planar section 111 is shown in FIGS. 3A to 3H and 4A to 4B and the adhesive 101 is shown in FIGS. 4A and 4B.)

Figure 2A:
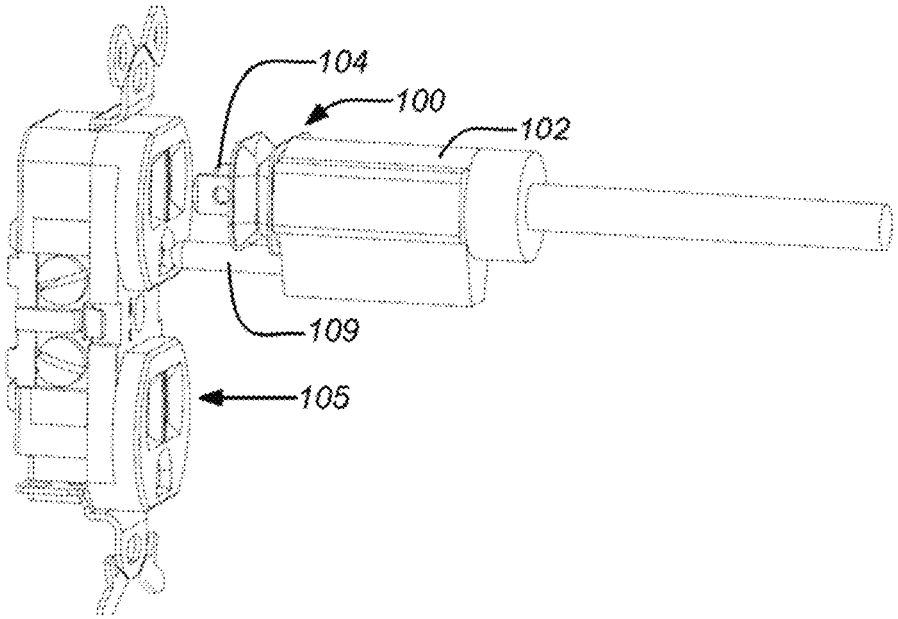
FIG. 2A illustrates a view of the electrical plug safety device depicted fully extended and affixed with adhesive to the face of a plug about to be inserted into an outlet.

FIG. 2A illustrates a view of the electrical plug safety device 100 depicted fully extended and affixed with adhesive to the face of a plug 102 about to be inserted into an outlet 105. Here the device 100 is shown installed on the plug as it is about to be connected to the outlet 105.

Figure 2B:
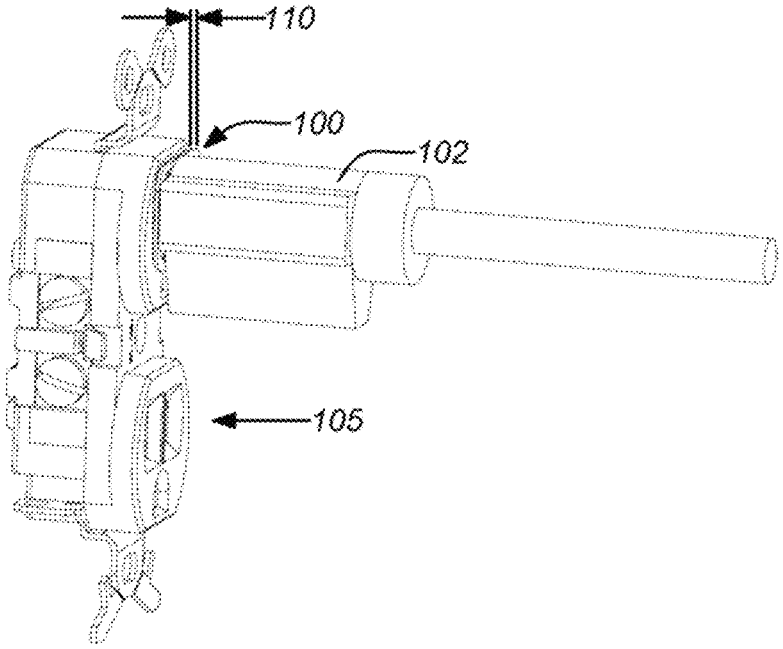
FIG. 2B illustrates a view of the electrical plug safety device depicted fully compressed into the face of a plug fully inserted into an outlet.

FIG. 2B illustrates a view of the electrical plug safety device 100 depicted fully compressed into the face of a plug 102 fully inserted into an outlet 105. The collapsible constriction 103 surrounding each prong 104 gets fully compressed to minimize the amount of space between the plug 102 and the outlet 105 so that the plug 102 does not pop out of the outlet 105 unless it is pulled out. Here the device 100 is shown (barely visible) with the plug 102 fully engaged in the outlet 105. The compressed height 110 of the device 100 between the face of the plug 102 and the outlet 105 is minimal.

Figure 2C:
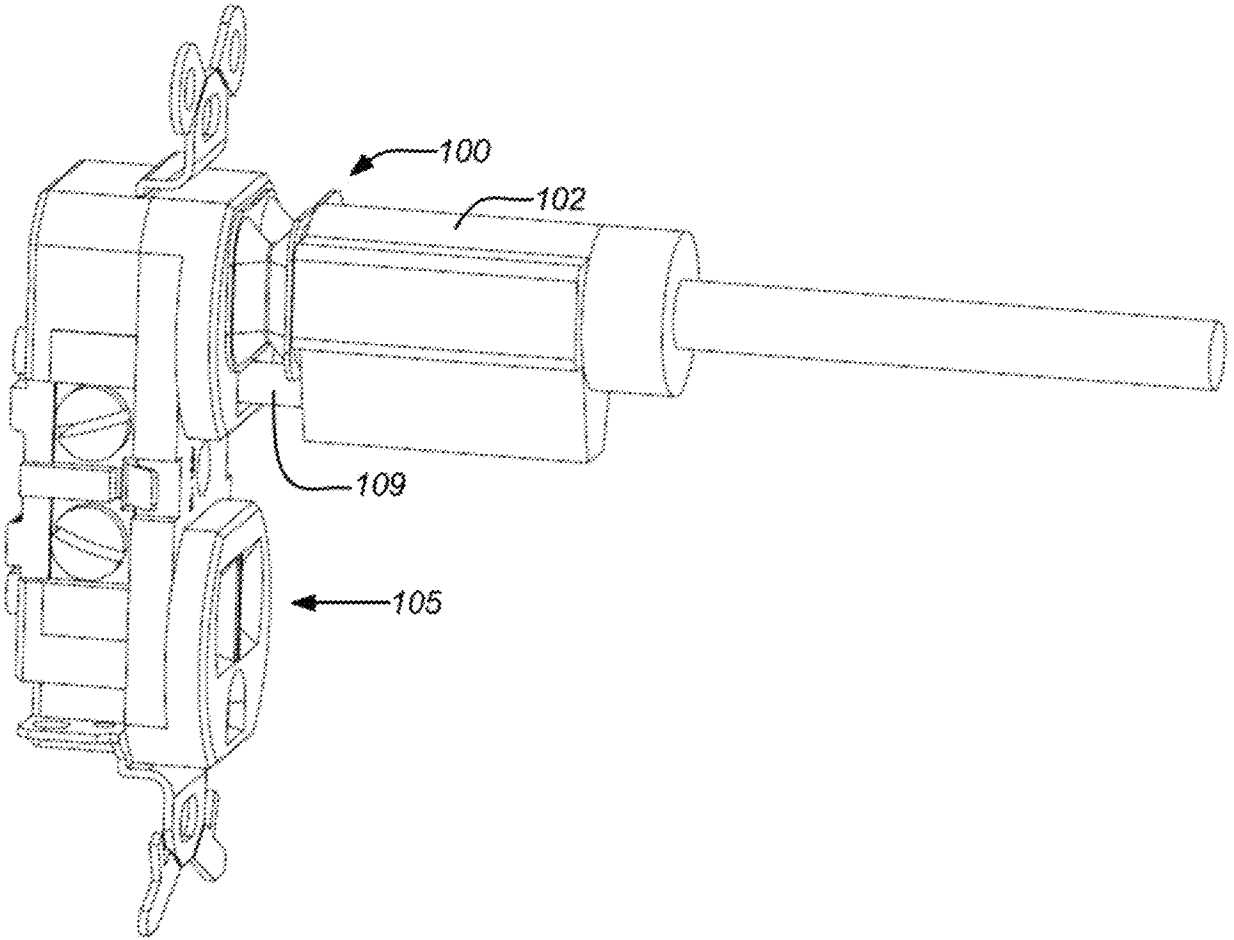
FIG. 2C illustrates a view of the electrical plug safety device depicted fully extended from the face of a plug partially pulled out of an outlet.

FIG. 2C illustrates a view of the electrical plug safety device 100 depicted fully extended from the face of a plug 102 partially pulled out of an outlet 105. Immediately as the plug 102 is being pulled and the prongs 104 are withdrawing from the outlet 105 the electrical plug safety device 100 expands to protect individuals from accessing the live prongs 104. The prongs 104 are only live for approximately the first inch of removal from the outlet 105. Accordingly, at least 10% of the length of the prongs require insulation. Thus, typically the extended height 106 of the collapsible sleeves 113 and thicknesses of the first planar section 112 and the second planar section 111 is at least 10% (but more typically 35%-40%) of the length of a prong 104 of an electrical plug 102 in order to shield a user while the plug is being withdrawn from the outlet or female plug. In one example, the electrical plug safety device 100 can have an extended height 106 of approximately ¼ inch when not compressed.

Reducing the extended height 106 makes it possible to achieve a reduced compressed height 110 when the electrical plug safety device 100 is fully compressed between an installed plug 102 and the face of an electrical outlet 105. As previously mentioned, under typical conditions, the ground prong 109 does not carry significant current, so it is unnecessary to surround it with a non-conductive elastomeric material. Here the device 100 is shown protecting a user from electric shock as the plug 102 is being connected or disconnected from the outlet 105. In this position, the prongs 104 of the plug 102 are electrically connected to the outlet 105 and therefore would render an electric shock if contacted by the user. However, the extended device 100 shields the user from any such contact.

Figure 3A:
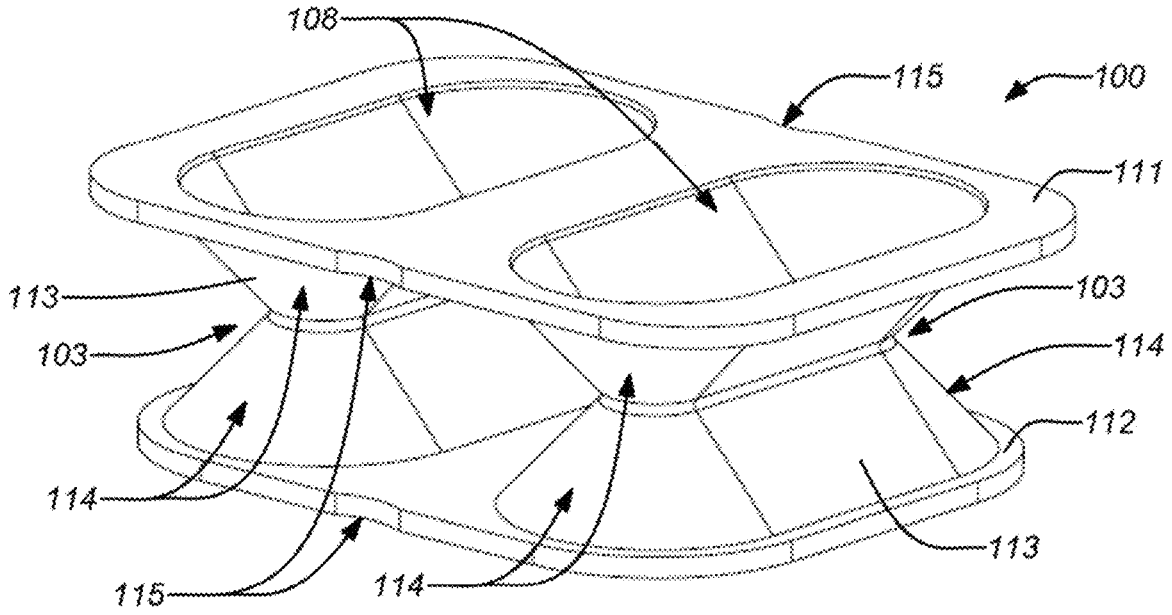
FIG. 3A illustrates a high isometric view of the electrical plug safety device.
Figure 3B:
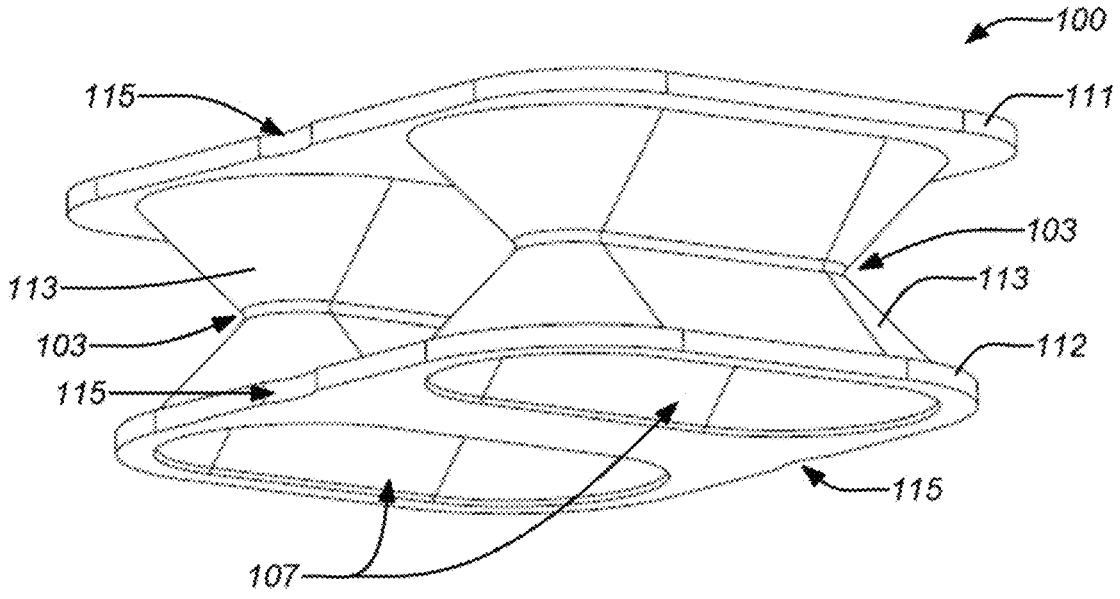
FIG. 3B illustrates a low isometric view of the electrical plug safety device.
Figure 4A:
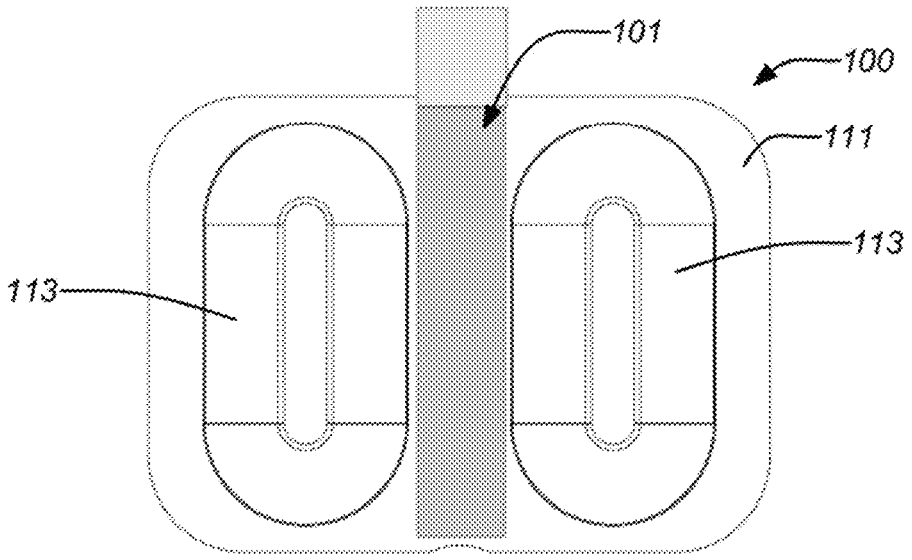
FIG. 4A illustrates a rear view of the electrical plug safety device showing a strip of adhesive between the passages to affix the electrical plug safety device to a plug.
Figure 4B:
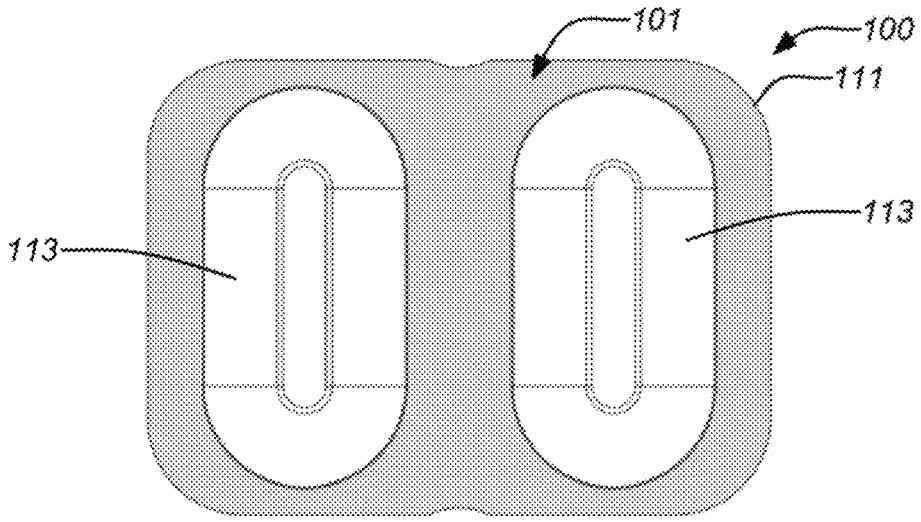
FIG. 4B illustrates a rear view of the electrical plug safety device showing adhesive covering the entire surface of the planar section to affix the electrical plug safety device to a plug.

FIGS. 3A and 3B illustrate high and low isometric views, respectively, of the electrical plug safety device 100. The device 100 comprises a first planar section 112 in the front and a second planar section 111 in the rear that each have a pair of holes 107, 108 therethrough. A pair of collapsible passages 113 each have a first opening joined to one of the first pair of holes of the first planar section 112 and each have a second opening joined to one of the second pair of holes of the second planar section 111. The pair of collapsible passages 113 can be joined with the first planar section 112 and the second planar section 111 to form a pair of scaled conduits from a front side of the first planar section 112 to a backside of the second planar section 111. Each of the pair of collapsible passages 113 comprises a single constriction 103 between the first opening and the second opening. In addition, a small notch 115 can be included in edges of each of the planar sections 111, 112 to better clear the ground prong 109 when used with a three prong plug as shown in FIGS. 1A and 1B. As the device 100 is symmetrical, parallel notches 115 can also be included on the opposite edges of the planar sections 111, 112 as shown.

Typically, the device 100 comprises a unitary structure. Accordingly, the device 100 can be injection molded from a resilient (non-conductive) material such that the device 100 ordinarily remains in an extended condition. The device 100 can be compressed and held closed under the retention force between a face of an electrical plug 102 engaged in an outlet 105 and automatically returns to the extended condition (around the prongs 104 of the plug 102) upon removal of the electrical plug 102 from the outlet 105. As shown, the walls of each of the pair of collapsible passages 113 form half conical sections 114 at each end.

Figure 3C:
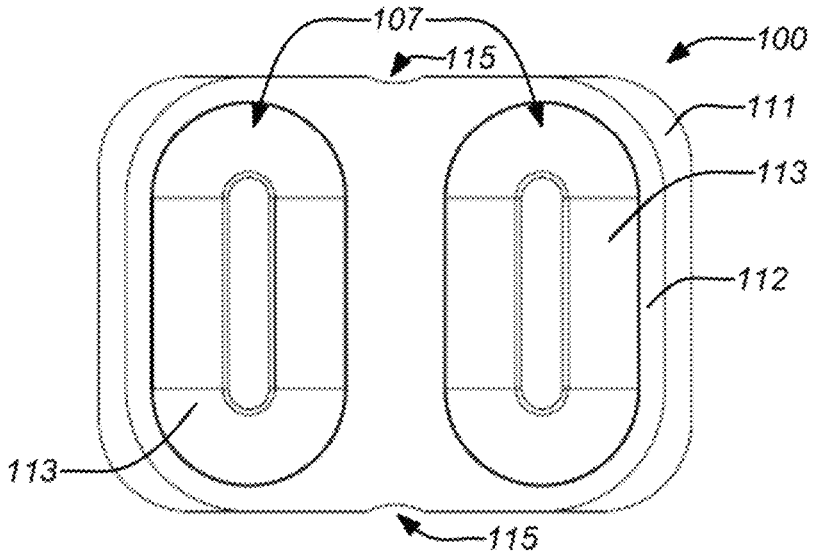
FIG. 3C illustrates a front view of the electrical plug safety device.

FIGS. 3C-3H illustrate a front, side, rear, top and two cross-section views, respectively, of the electrical plug safety device. FIG. 3C is a front view of the electrical plug safety device 100 viewed through the holes 107 that the prongs 104 exit from the first planar section 112 in use.

Figure 3D:
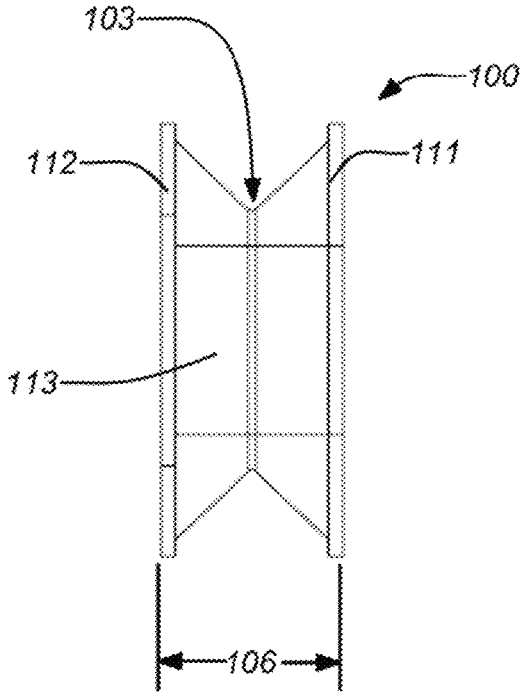
FIG. 3D illustrates a side view of the electrical plug safety device fully extended.

FIG. 3D is a side view of the electrical plug safety device 100 showing the constriction 103 that surrounds one prong 104 of a plug 102. On the surface of the second planar section 111 of the device 100 there is an adhesive 101 (e.g. double-sided tape) with which the user can affix the electrical plug safety device 100 to the face of a plug 102.

Figure 3E:
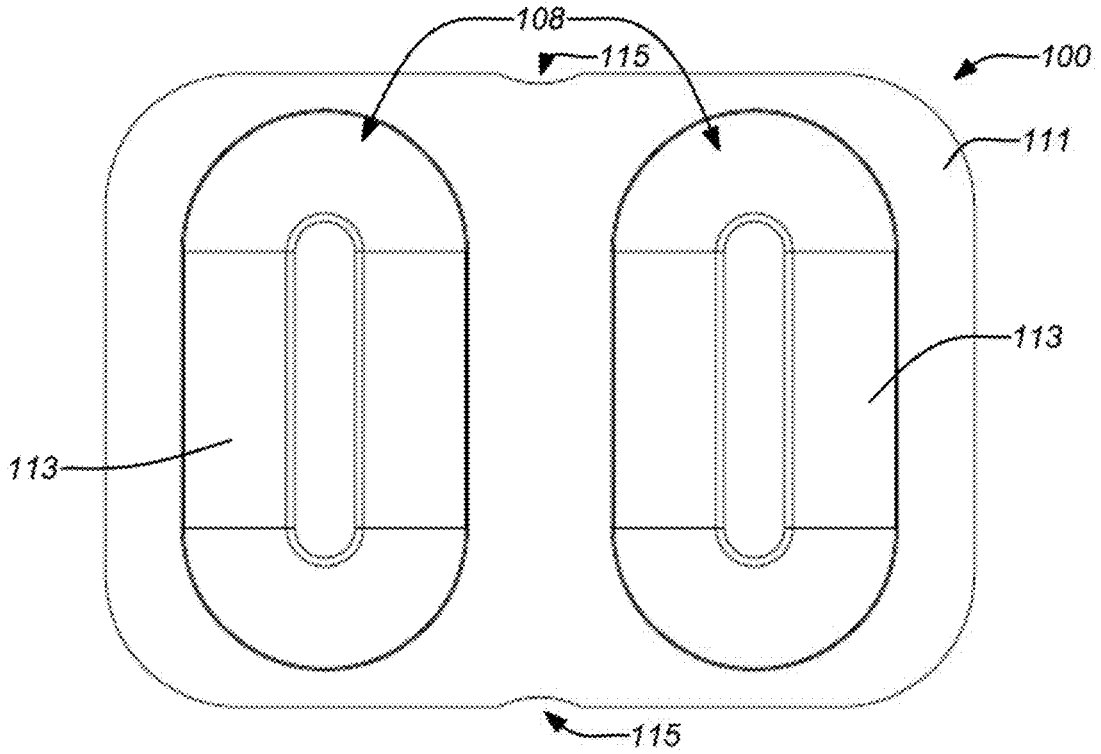
FIG. 3E illustrates a rear view of the electrical plug safety device where adhesive would be used to affix the electrical plug safety device to a plug.

FIG. 3E is a rear view of the electrical plug safety device 100 viewed through the holes 108 that the prongs 104 enter from the second planar section 111 in use. The adhesive 101 (e.g. double-sided tape) is affixed to the electrical plug safety device 100 on this side that the prongs 104 enter. If adhesive tape is used, wax paper affixed to the adhesive 101 would be removed to affix the electrical plug safety device 100 to the face of a plug 102. From this view, the single constriction 103 of each of the pair of collapsible passages 113 is shown to comprise an elongated oval opening for a prong 104 of an electrical plug 102 as previously shown in FIGS. 1A and 1B. The rounded ends of the elongated oval opening result in the walls of each of the pair of collapsible passages 113 forming half conical sections 114 at each end as previously mentioned.

Figure 3F:
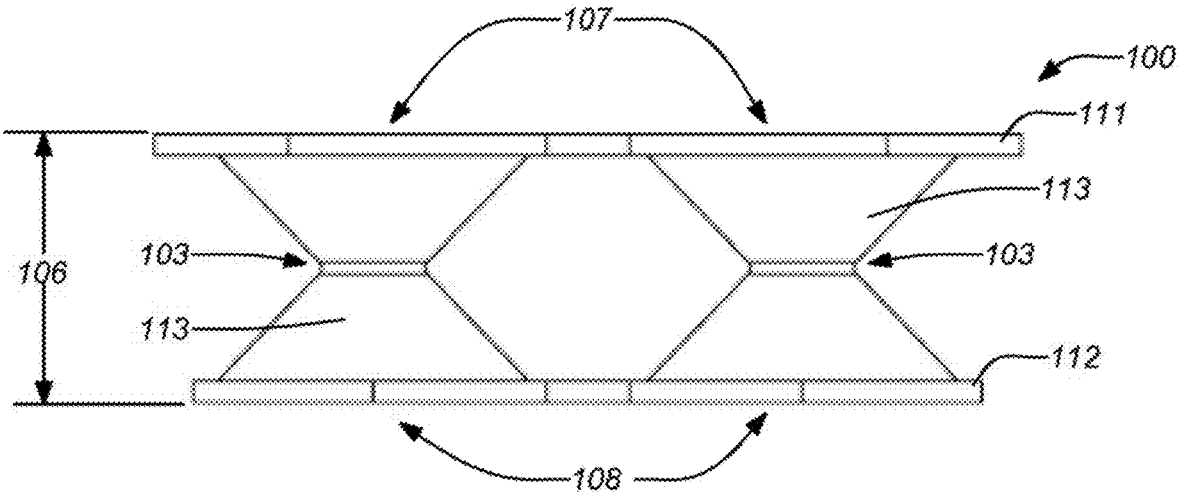
FIG. 3F illustrates a top view of the electrical plug safety device fully extended.

FIG. 3F is a top view of the electrical plug safety device 100 with each constriction 103 visible. The prongs 104 of the plug 102 enter through holes 107 in the second planar section 111 in the rear. The surface of the second planar section 111 is affixed with the adhesive 101 (e.g. double-sided tape) onto the front surface of the electrical plug 102. The prongs 104 exit through the holes 108 of the first (front) planar section 112. In the example device 100, the walls of each of the pair of collapsible passages 113 extend at angles of approximately 45 degrees from the first and second planar sections 111, 112 and at approximately 45 degrees. Note that the angle is measured from the interior of the passages 113. This angle also defines the walls of each of the pair of collapsible passages 113 which form half conical sections 114 at each end.

Figure 3G:
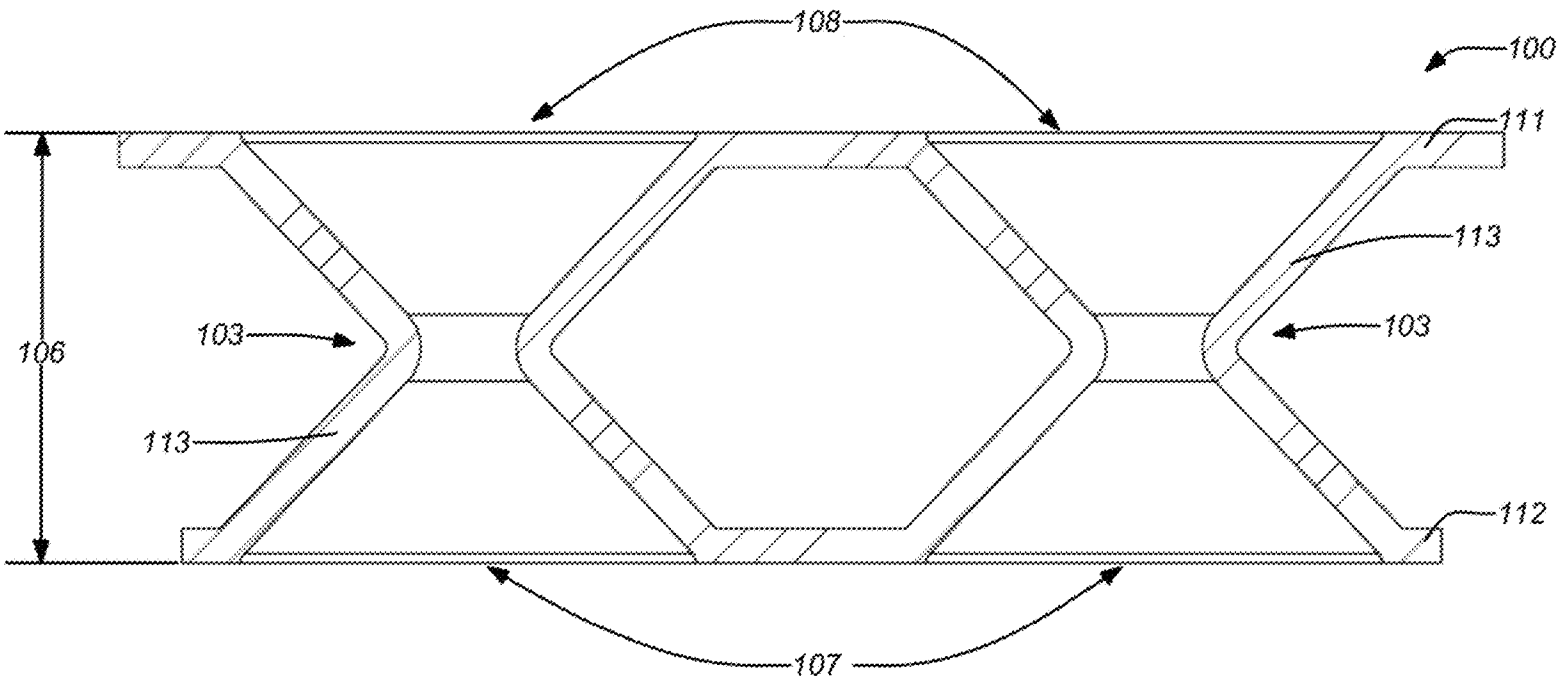
FIG. 3G illustrates a cross section view of the electrical plug safety device fully extended.
Figure 3H:
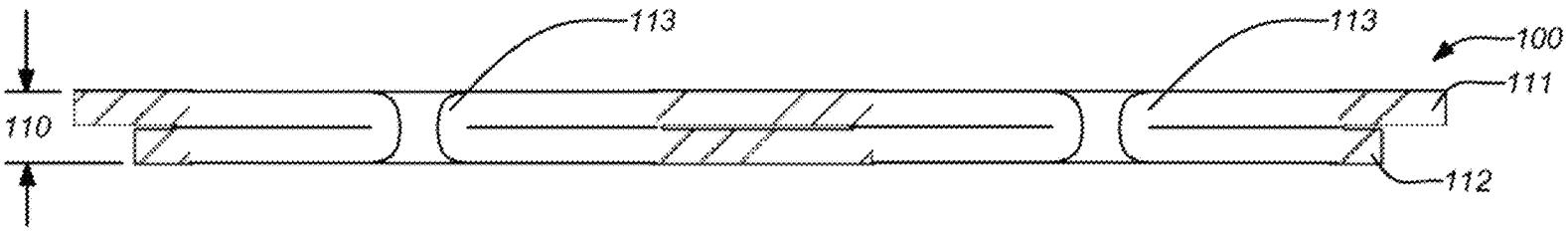
FIG. 3H illustrates a cross section view of the electrical plug safety device fully compressed.

FIG. 3G illustrates a cross section view of the electrical plug safety device 100 fully extended and FIG. 3H illustrates a cross section view of the electrical plug safety device 100 fully compressed. The first pair of holes 107 in the first (front) planar section 112 and the second pair of holes 108 in the second (rear) planar section 111 comprise space into which the pair of collapsible passages 113 deform when the first planar section 112 and the second planar section 111 are compressed together. This allows for a greatly reduced compressed height 110 from the fully extended height 106 as shown. Symmetry of the passages 113 also helps to facilitate this. Accordingly, the single constriction 103 of each of the pair of collapsible passages 113 is preferably substantially midway between the first opening and the second opening. As shown in FIG. 3H there is a small gap between the opposing sides of the collapsible passage 113 to accommodate the plug prong 104 when collapsed. This gap is much wider when viewed from the side to accommodate the wider dimension of the prongs 104.

FIG. 4A illustrates a rear view of the electrical plug safety device 100 showing a strip of adhesive 101 between the passages 113 to affix the electrical plug safety device 100 to a plug 102. The backside of the first (front) planar section 112 includes an adhesive 101 area for affixing to a front surface of an electrical plug 102. Here, the adhesive 101 area comprises a region between the second pair of holes 108 on the backside of the second planar section 111.

FIG. 4B illustrates a rear view of the electrical plug safety device 100 showing adhesive covering the entire surface of the second (rear) planar section 111 to affix the electrical plug safety device 100 to a plug 102. Here, the adhesive 101 area comprises substantially all flat surface of the backside of the second planar section 112. As shown, the second (rear) planar section 111 is larger than the first planar section 112 to afford greater surface area for the adhesive 101.

The electrical plug safety device 100 can comprise a non-conducting elastomeric material. Those skilled in the art will understand there are a range of known suitable materials. The material must be non-conductive to prevent shock. In addition, the material must be hold its shape and be resilient enough to return to its shape after being repeatedly deformed and held in a compressed shape for a long period of time. The material is preferably elastic such that it can be deformed around the plug prongs, particularly when the device 100 is compressed between the plug 102 and the outlet 105.

The electrical plug safety device 100 can be formed from a non-conductive material. Ideally, a non-conductive elastomeric material can be used. The material requires sufficient resilience to repeatedly return to its original extended shape after being fully compressed and held for periods between a plug and outlet or female plug. In addition, the material must be suitably strong so that it can be produced in a very thin walled configuration enabling a very thin compressed height between the plug and outlet or female plug.

As shown above, the device employs a single constriction 103 for each prong so the electrical plug safety device 100 will compress when the plug 102 and its prongs 104 are inserted into the outlet 105 occupying minimal space. In contrast, multiple constrictions (i.e. corrugations), as used with prior art devices, would increase the required space between the plug and the outlet and may cause the plug to inadvertently disengage from the outlet.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. An electrical plug safety device, comprising a first planar section having a first pair of holes therethrough;

a second planar section having a second pair of holes therethrough; and a pair of collapsible passages each having a first opening joined to one of the first pair of holes of the first planar section and each having a second opening joined to one of the second pair of holes of the second planar section;

wherein the device comprises a unitary structure and each of the pair of collapsible passages comprises a single constriction between the first opening and the second opening.

2. The electrical plug safety device of claim 1, wherein the device is compressed from an extended condition and held closed under retention force between a face of an electrical plug engaged in an outlet and returns to the extended condition upon removal of the electrical plug from the outlet.

3. The electrical plug safety device of claim 1, wherein the unitary structure is injection molded from a resilient material.

4. The electrical plug safety device of claim 1, wherein the resilient material comprises a non-conducting elastomeric material.

5. The electrical plug safety device of claim 1, wherein the first pair of holes in the first planar section and the second pair of holes in the second planar section comprise space into which the pair of collapsible passages deform when the first planar section and the second planar section are compressed together.

6. The electrical plug safety device of claim 1, wherein the single constriction of each of the pair of collapsible passages comprises an elongated oval opening for a prong of an electrical plug.

7. The electrical plug safety device of claim 1, wherein the single constriction of each of the pair of collapsible passages is substantially midway between the first opening and the second opening.

8. The electrical plug safety device of claim 1, wherein the pair of collapsible passages are joined with the first planar section and the second planar section to form a pair of sealed conduits from a front side of the first planar section to a backside of the second planar section.

9. The electrical plug safety device of claim 1, wherein an extended height of the collapsible sleeves and thicknesses of the first planar section and the second planar section is at least 10% of a length of a prong of an electrical plug.

10. The electrical plug safety device of claim 1, wherein walls of each of the pair of collapsible passages extend at approximately 45 degrees from the first planar section and at approximately 45 degrees from the second planar section towards the constriction.

11. The electrical plug safety device of claim 10, wherein the walls of each of the pair of collapsible passages form half conical sections at each end.

12. The electrical plug safety device of claim 1, wherein a backside of the second planar section includes an adhesive area for affixing to a front surface of an electrical plug.

13. The electrical plug safety device of claim 12, wherein the second planar section is larger than the first planar section to afford greater surface area for the adhesive area.

14. The electrical plug safety device of claim 12, wherein the adhesive area comprises all flat surface of the backside of the second planar section.

15. The electrical plug safety device of claim 12, wherein the adhesive area comprises a region between the second pair of holes on the backside of the second planar section.

16. An electrical plug safety device, comprising a first planar section having a first pair of holes therethrough;

a second planar section having a second pair of holes therethrough; and a pair of collapsible passages each having a first opening joined to one of the first pair of holes of the first planar section and each having a second opening joined to one of the second pair of holes of the second planar section;

wherein each of the pair of collapsible passages comprises a single constriction between the first opening and the second opening;

wherein the device comprises a unitary structure injection molded from a non-conducting elastomeric material and the first pair of holes in the first planar section and the second pair of holes in the second planar section comprise space into which the pair of collapsible passages deform when the first planar section and the second planar section are compressed together.

17. The electrical plug safety device of claim 16, wherein the first pair of holes in the first planar section and the second pair of holes in the second planar section comprise space into which the pair of collapsible passages deform when the first planar section and the second planar section are compressed together.

18. The electrical plug safety device of claim 16, wherein the single constriction of each of the pair of collapsible passages comprises an elongated oval opening for a prong of an electrical plug.

19. The electrical plug safety device of claim 16, wherein the single constriction of each of the pair of collapsible passages is substantially midway between the first opening and the second opening.

* * * * *